United States Patent [19]

Lindgren

[11] 4,295,469

[45] Oct. 20, 1981

[54] BRASSIERE CONSTRUCTION

[76] Inventor: Hazelle C. Lindgren, Rte. 4, Box 283A, Buffalo, Minn. 55313

[21] Appl. No.: 953,273

[22] Filed: Oct. 20, 1978

[51] Int. Cl.[3] ..... A41C 3/10; A41C 3/00

[52] U.S. Cl. ..... 128/480; 128/485

[58] Field of Search ..... 128/485, 479, 480, 481, 128/482, 500, 477, 483

[56] References Cited

U.S. PATENT DOCUMENTS

| | | | |
|---|---|---|---|
| 1,904,644 | 4/1933 | Le May | 128/483 |
| 2,773, 261 | 12/1956 | Schamumer | 128/510 |
| 3,066,676 | 12/1962 | Kaupp | 128/482 |
| 3,698,399 | 10/1972 | Hand | 128/483 |

FOREIGN PATENT DOCUMENTS

| | | | |
|---|---|---|---|
| 155173 | 2/1954 | Australia | 128/480 |
| 718225 | 3/1942 | Fed. Rep. of Germany | 128/477 |
| 1128629 | 10/1956 | France | 128/477 |
| 263021 | 1/1951 | Switzerland | 128/477 |
| 866312 | 1/1962 | United Kingdom | 128/477 |

OTHER PUBLICATIONS

Sears, Roebuck and Co., Jul. 1977, p. 184, Sling Support Bra.

*Primary Examiner*—Doris L. Troutman

*Attorney, Agent, or Firm*—Merchant, Gould, Smith, Edell, Welter & Schmidt

[57] ABSTRACT

A brassiere construction designed particularly for use by women having relatively large breasts wherein the abnormal weight thereof may cause soreness in the neck, back and the breasts themselves, the brassiere having a body encircling member or vest with fastening means on the ends adapted to be connected at the front of the wearer's body, said member having substantial elasticity to comfortably adjust to the body and the end portions thereof having breast holding cups of fabric material mounted therein to cover the front of the wearer's breasts, shoulder straps extending from just over the cups to the upper edge of the back portion of the member, and said cups having built therein semi-circular slings of absorbent material to extend under the breasts to aid in supporting the same and absorb moisture in the area under the breasts.

3 Claims, 3 Drawing Figures

BRASSIERE CONSTRUCTION

BACKGROUND OF THE INVENTION

Women with extraordinarily heavy breasts have problems with normally constructed brassieres in that they are not designed to provide adequate uplift for maximum comfort and appearance. Frequently, where proper breast support is not provided, such women incur aches and pains in the back, shoulders, neck and even the head due to strains involved in attempting to maintain upright posture.

In addition, where there is improper uplifting support of heavy breasts they tend to lie against the upper abdominal areas of the body causing perspiration therebetween as well as skin abrasions.

While various brassiere designs have heretofore been provided to solve these problems, they have generally resulted in unyielding, harnesslike garments which are not comfortable for the wearer. Additionally, in many instances they have been so designed as to be very difficult for the user to secure the garment to or remove it from a normally worn position on the body.

Examples of such brassieres are found in U.S. Pat. No. 1,937,008; No. 2,052,707; and No. 3,890,978.

SUMMARY OF THE INVENTION

A primary object of the present invention is to provide a brassiere for use by heavy breasted women which will provide a raise support for the breasts and yet which is comfortable to wear and easily applied to or removed from the body.

Another object of the invention is to provide a brassiere for heavy or sagging female breasts which provide a moisture absorption liner between the breasts and the body portions disposed immediately thereunder.

With these and other objectives in view the invention broadly comprises a brassiere having a body encircling vest member which is relatively deep vertically to engage around a substantial portion of the chest area of the wearer, said vest member being formed of alternate elastic and non-elastic fabric panels respectively spaced horizontally and with elastic strips extending along the top and bottom edges thereof, the end portions of the member adapted to be interconnected at the front of the wearer's chest and said portions carrying breast covering cups having slings of absorbent material built therein and adapted to extend under and giving elevating support to the breasts.

BRIEF DESCRIPTION OF THE DRAWINGS

In the drawings:

FIG. 1 is an inner or front view of the brassiere in open condition.

DESCRIPTION OF THE PREFERRED EMBODIMENT

Figure 2:
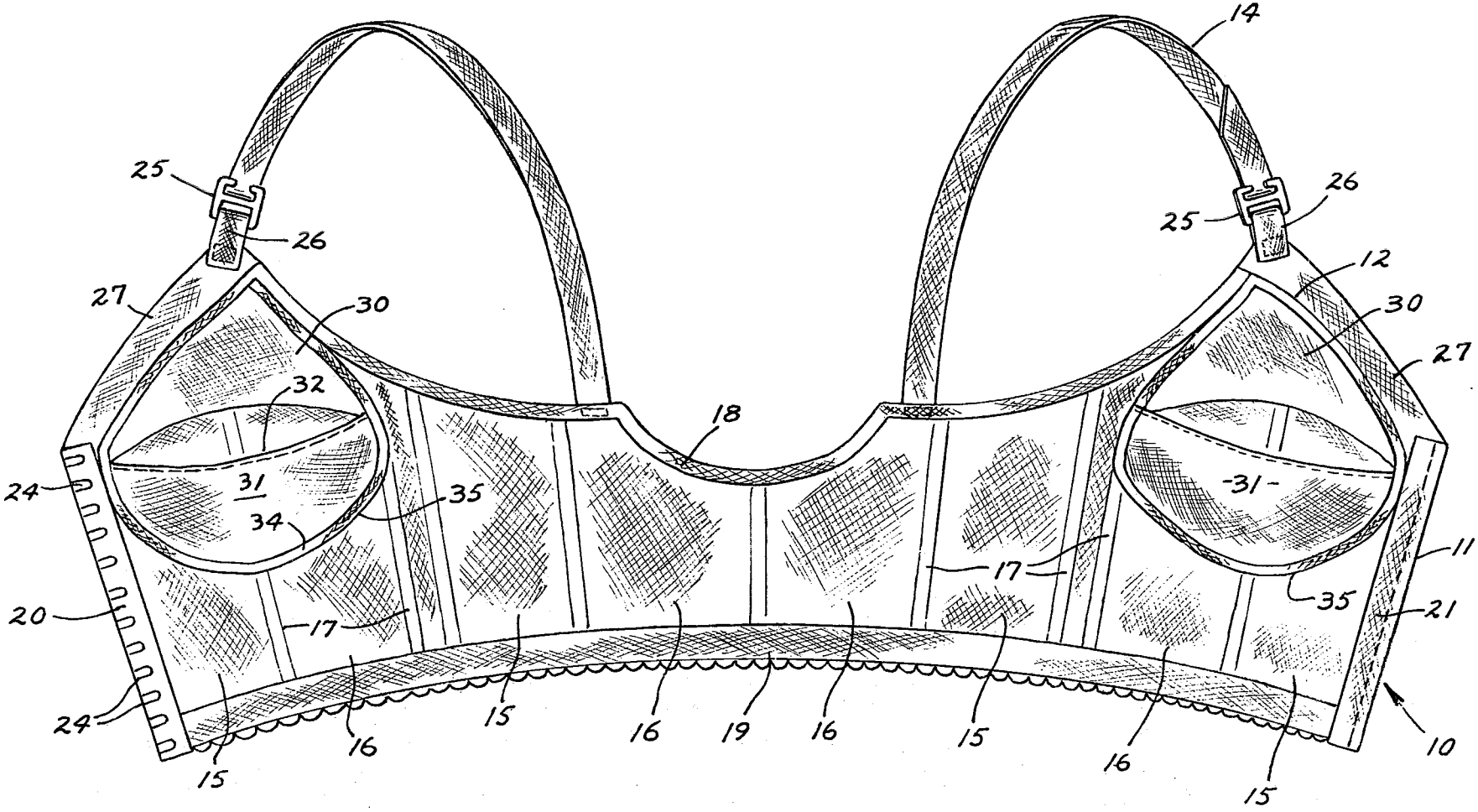
FIG. 2 is a front perspective view of the garment as it would apear in normally worn position on the body of the wearer.
Figure 2:
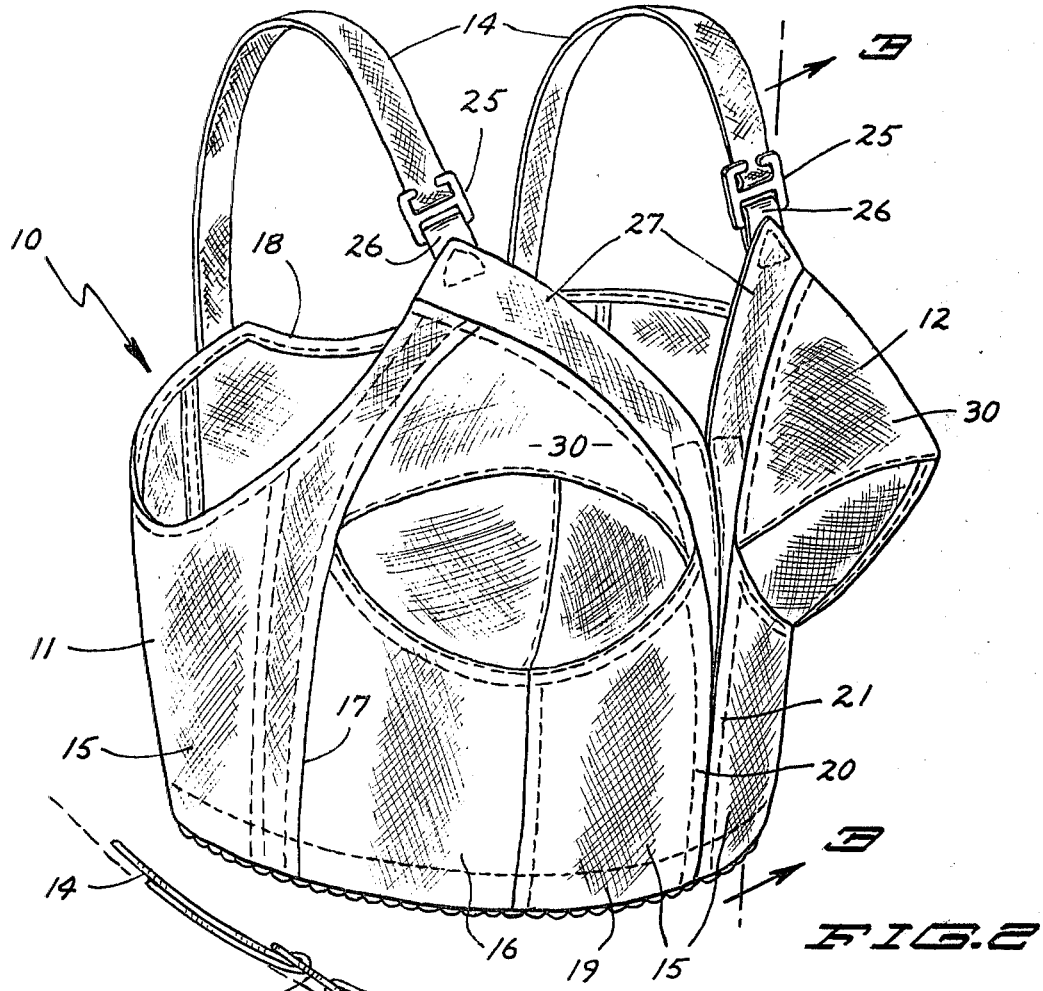
Figure 3:
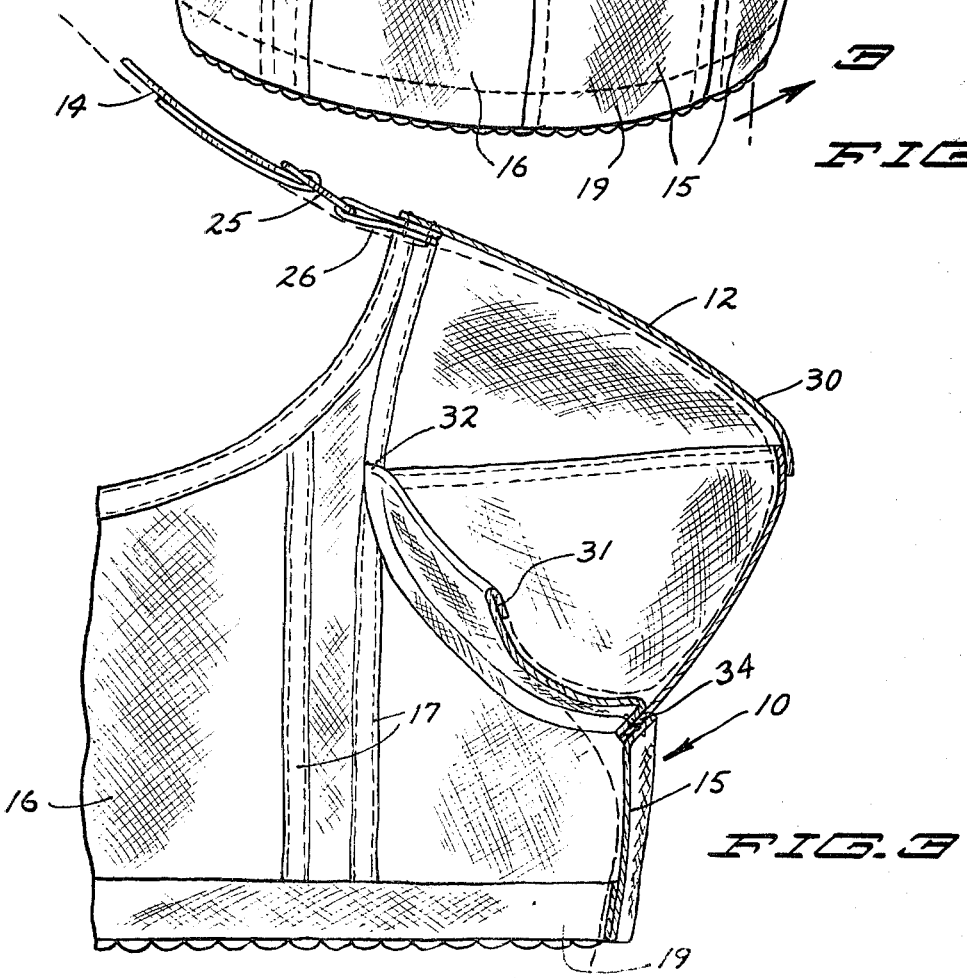
FIG. 3 is a vertical section through the garment taken on line 3—3 of FIG. 2.

Referring now more particularly to the drawings, reference numerals will be used to denote like parts or structural features in the different views. The brassiere is denoted generally by the numeral 10 and includes a main body encircling vest member 11 which carries the breast holding cups 12 and shoulder straps 14.

Member 11 consists of several fabric panels 15 and 16 interconnected by vertical strips 17. Top and bottom strips respectively designated at 18 and 19 of elasticized material extend along the panel edges, and end strips 20 and 21 are provided at the ends of member 11. The panels 16 are of elasticized stretchable material while the panels 15 are not. Accordingly, the members 18 and 19 are longitudinally stretchable or yieldable only in the sections thereof which connect strips 17 above and below the panels 16.

The end strip 20 has a plurality of vertically spaced hooks 24 stitched thereinto and adapted to mate and interlock with a series of equally spaced loops (not shown) on the end strip 21 to fasten the vest member 11 about the body of the wearer in a well known manner.

The shoulder straps 14 are adjustable in length through buckles 25 carried in loops 26. Loops 26 are attached to elasticized strips 27 which connect the ends of member 16 to the end strips 20 and 21.

As thus far described it will be understood that the brassiere 10 is yieldable longitudinally for comfort of the wearer by virtue of the elasticity of members 18, 19 and 16 as well as adjustable vertically on the wearer through the buckles 25 and loops 26.

The breast holding cups 12 each includes a generally hemispherically shaped outer covering 30 which has its marginal portions stitched to the various panels and strips hereinbefore defined. Cup 12 also includes a pocket or sling member 31 which has a generally semicircular or half-moon design with the center edge 32 up and unattached and the lower arcuate marginal portions 34 stitched to a strip 35 which extends between end strips 20 or 21 and the remote strip 17 on the adjacent panel 16. The member 31 is of sufficient depth or vertical dimension to extend completely under and upwardly behind the breast to the line of the juncture between the breast and chest.

The sling member 31 is formed of a relatively thick fabric material, such as flannel, which is relatively nonstretchable yet very soft and highly absorbent of moisture. A foldover hem forms the edge 32.

In donning the brassiere the wearer inserts the arms rearwardly through the shoulder straps, as viewed in FIG. 1, and wraps the vest forwardly about the body placing the breasts at each side of the body in the frontal positioned sling 31 and then fastens the ends of the vest through means of hooks 24 and the mating loops on strip 21. Of course, a zipper, snaps or other fastening means may be used. However, the frontal connection is important in this type of brassiere for proper mounting and adjustment of the cups on the breasts.

The broad skin surface contact of the vest on the body accompanied by proper adjustment of the shoulder straps creates a firmly anchored base for the brassiere to hold the cups 30 at the desired level of elevation. However, the elasticity of the panels 16, and strips 18, 19 and 27, provides for a comfortable fit and allows freedom of body movement. It will be understood that connection of straps 14 with the elastic members 16 and 27 allows a certain amount of yieldability in a vertical direction.

With the vest member properly adjusted on the body the sling or pocket members 31 will give a firm yet comfortable support for the breasts holding them away from the body and absorbing any body perspiration that may occur in the area.

I have accordingly provided a brassiere construction which economically and effectively carries out the aforementioned objectives.

Having now therefore fully illustrated and described my invention, what I claim to be new and desire to protect by United States Letters Patent is:

1. A brassiere construction for a brassiere having a latchable, elongated vest member encircling the wearer's body, a pair of breast covering cups with upper and lower edge portions and a pair of shoulder straps, said brassiere construction comprising:

a pair of fabric material elements having upper and lower edges, each said fabric material element being flexibly secured at its lower edge to said brassiere near the lower edge portion of a cup, said material extending upwardly at least to a location for contacting the lower junction of the breast and the lower rib cage, whereby said fabric material element may pivot about the lower edge inwardly away from the cup to form a pouch within which a breast may be contained, said material thereby laying between the underside of a breast and the wearer's lower rib cage.

2. The method of preventing irritation in the contact region between a woman's breasts and her lower rib cage, said method comprising the steps of:

attaching to a brassiere having cups a pair of relatively non-stretchable, highly absorbent fabric material elements near the lower edge of the cups, wearing the brassiere so as to place said material on the entire contact region between the wearer's breasts and her lower rib cage.

3. The subject matter of claim 1 wherein said fabric material are formed of a relatively non-stretchable highly absorbent material.

* * * * *